United States Patent [19]

Emerson

[11] Patent Number: 4,624,185

[45] Date of Patent: Nov. 25, 1986

[54] MISSILE BALLAST ASSEMBLY

[75] Inventor: John D. Emerson, Arab, Ala.

[73] Assignee: The United States of America as represented by the Secretary of the Army, Washington, D.C.

[21] Appl. No.: 762,469

[22] Filed: Aug. 5, 1985

[51] Int. Cl.[4] ..... F41G 7/32; F42B 15/04

[52] U.S. Cl. ..... 102/293; 244/3.12

[58] Field of Search ..... 102/293, 504; 244/3.12

[56] References Cited

U.S. PATENT DOCUMENTS 3,266,423 8/1966 Simpson ..... 244/3.12
3,286,947 11/1966 Erickson ..... 244/3.12
3,319,781 5/1967 Simpson et al. ..... 244/3.12
4,505,203 3/1985 Brady et al. ..... 102/293

FOREIGN PATENT DOCUMENTS 1019184 11/1957 Fed. Rep. of Germany ..... 244/3.12

*Primary Examiner*—Charles T. Jordan
*Attorney, Agent, or Firm*—Anthony T. Lane; Robert P. Gibson; Harold W. Hilton

[57] ABSTRACT

An add-on ballast assembly for adding on to a missile in the field in a facile manner. The ballast is added in the unused hollow center of bobbins secured in the aft end of the missile. The bobbins have guidance wires wound therearound to be dispensed during flight. The addition of the ballast changes the center of gravity of the missile.

3 Claims, 2 Drawing Figures

MISSILE BALLAST ASSEMBLY

DEDICATORY CLAUSE

The invention described herein may be manufactured, used, and licensed by or for the Government for governmental purposes without the payment to me of any royalties thereon.

BACKGROUND OF THE INVENTION

One U.S. Army missile system is a tube launched line of sight missile which relies on its forward wings to provide lift during flight. Thus, the position of the center of gravity of the missile in relation to its wings is of utmost importance to its flight characteristics. During a recent development program it was noted that the nose portion of one type of wire guided missile (TOW) tended to dip downwardly during flight. It was, therefore, decided to change the flight characteristics of the missile by changing the center of gravity of the missile. This may be accomplished by adding ballast to the aft fuselage of the missile. However, the missile fuselage is assembled together in sections with the use of magnaformed joints which cannot be easily reassembled once removed. Therefore, it was desirable to find a way to add ballast to the missiles without breaking the skin of the missile or the magnaform joints.

It is, therefore, an object of the present invention to provide an add-on ballast assembly for a missile.

It is a further object of the present invention to provide such a ballast assembly that may be assembled to the missile in a fast and facile manner.

It is yet a further object of the present invention to provide such an add-on ballast assembly to a missile without breaking the skin or joints of the missile while maintaining the missile's aerodynamic configuration.

SUMMARY OF THE INVENTION

An add-on Ballast assembly for use in a tube launched line of sight missile. The missile includes a rocket motor in its aft end and a pair of bobbins having guidance wires wound thereon and which are dispensed or "payed out" during flight. Each bobbin is positioned 180° apart on opposite sides of the motor. The bobbins are enclosed in a shroud secured in the aft end of the missile. The ballast assemblies are elongated members of predetermined weight which are secured in the normally unused hollow center of the bobbins.

DESCRIPTION OF PREFERRED EMBODIMENT

Figure 1:
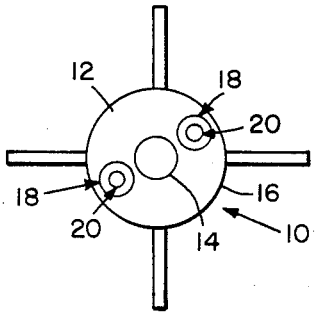
FIG. 1 is an end elevational view of the aft end of a missile having bobbins therein and ballast members in the bobbins.

As seen in FIG. 1, a missile 10 includes an aft end 12 having a motor 14 enclosed in a skin 16. A pair of bobbin assemblies 18 are mounted in the missile 10 on opposite sides of the motor 14. Ballast assemblies 20 including ballast weights or members 22 are mounted in bobbin assemblies 18.

Figure 2:
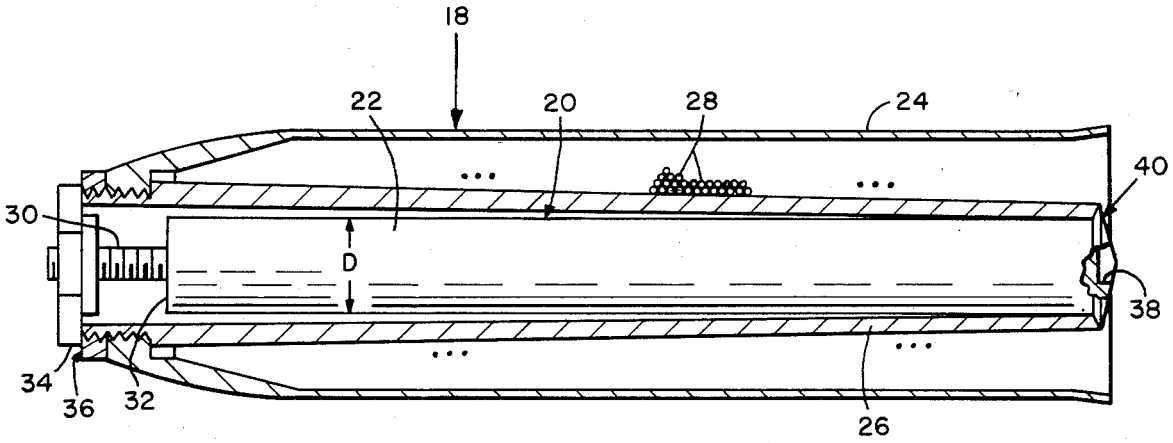
FIG. 2 is an elevational sectional view of one of the bobbins and the ballast assembly of the present invention inserted in the bobbin.

As more clearly seen in FIG. 2 the bobbin assembly 18 includes a shroud 24 enclosing a hollow bobbin 26 having a small diameter guidance wire 28 wound therearound.

Ballast assemblies 20 (FIG. 2) include ballast members 22 leaving a threaded shaft 30 extending from the forward end 32 thereof. A nut 34 is provided for threaded relation with shaft 30.

To assemble the ballast assembly into the missile, the launch motor 14 is disconnected (unscrewed) and removed from the missile (takes approximately 5 minutes) and ballast nut 34 is held in place at the forward end 36 of the shroud while the ballast weight 22 is placed in the bobbin 26 and secured into the nut. Threaded shaft 30 extends from the end 32 of the ballast weight for the threaded engagement with nut 34. Locktite may be used to strengthen the screw joint. Nut 34 may be held in place for the assemblying procedure by a forked tool (not shown) which extends through the opening left by the removal of the motor and supports the nut while the ballast number 22 is threaded thereto. A slot 38 is provided in the distal end 40 of ballast member to receive a screwdriver for assemblying the ballast member 22 to the shroud. The tool is removed after the assembly procedure and the motor is threaded back in place. The material of the ballast weight may be a non-magnetic stainless steel in order to lessen any electromagnetic effects this steel core may have on the electrified copper wire being dispensed from the bobbin.

If desired, the diameter D of member 22 may be varied to achieve a larger or smaller ballast mass.

I claim:

1. In a wire guided missile having bobbin assembly means carried in the aft end of said missile for dispensing electrified guidance wire therefrom, a ballast assembly carried in said bobbin assembly means for varying the center of gravity of said missile.

2. Apparatus as in claim 1 wherein said bobbin assembly means includes a hollow bobbin shaft having said guidance wire wound therearound and said ballast assembly including a ballast weight mounted in said hollow shaft.

3. Apparatus as in claim 2 wherein said ballast weight is provided with a threaded shaft extending from a first end thereof and a nut disposed for abutting a first end of said hollow bobbin and for threaded relation with said threaded shaft.

* * * * *